US006406407B1

(12) United States Patent
Wiedmann et al.

(10) Patent No.: US 6,406,407 B1
(45) Date of Patent: Jun. 18, 2002

(54) JUMP ROPE DEVICE

(76) Inventors: Pamela Dean Wiedmann; Robert Scott Wiedmann, both of 1017 N. Belmont Ave., Arlington Hts, IL (US) 60004

( * ) Notice: Subject to any disclaimer, the term of this patent is extended or adjusted under 35 U.S.C. 154(b) by 0 days.

(21) Appl. No.: 09/699,731

(22) Filed: Oct. 30, 2000

(51) Int. Cl.[7] ..... A63B 5/22
(52) U.S. Cl. ..... 482/82; 482/81
(58) Field of Search ..... 294/64.1; 248/362, 248/363; 482/81, 82

(56) References Cited

U.S. PATENT DOCUMENTS

| | | | | |
|---|---|---|---|---|
| 22,551 | A | * | 1/1859 | Duchamn |
| 566,816 | A | * | 9/1896 | Taylor et al. |
| 770,869 | A | | 9/1904 | Roe |
| 789,332 | A | | 2/1905 | Goldsmith |
| 2,918,282 | A | * | 12/1959 | Waterval |
| 4,158,457 | A | | 6/1979 | Hydro |
| 4,736,945 | A | | 4/1988 | Vinciguerra |
| 5,167,599 | A | | 12/1992 | Haller |
| 5,373,814 | A | | 12/1994 | Seymour |
| 5,549,528 | A | | 8/1996 | Bryant |

* cited by examiner

*Primary Examiner*—Jerome W. Donnelly
(74) *Attorney, Agent, or Firm*—Robert A. Stenzel

(57) ABSTRACT

A compact, lightweight, safe and convenient jump rope assembly that allows quick and easy attachment and detachment of an end attachment device to and from a great variety of support surfaces and thereby promotes and encourages aerobic and educational play by a greater number of participants includes a unique suction gripping portion having a quick release feature and a relatively friction free easy turning ball and socket rope connection portion attached to one end of a jump rope. The suction gripping portion has a circumferential lip structure that allows quick, easy and intuitive release by those present, including young children, in the event of an emergency or at the end of play. An intermediate adapter plate having releasable adhesive on one side and a suitable suction portion accepting surface on the other greatly extends the surfaces to which the assembly may be attached and thereby further promotes its use. Both the suction portion and adapter plate are made of materials that leave no evidence of having been attached to a surface which further promotes their use. Safety is further enhanced by a smooth design with rounded surfaces.

13 Claims, 4 Drawing Sheets

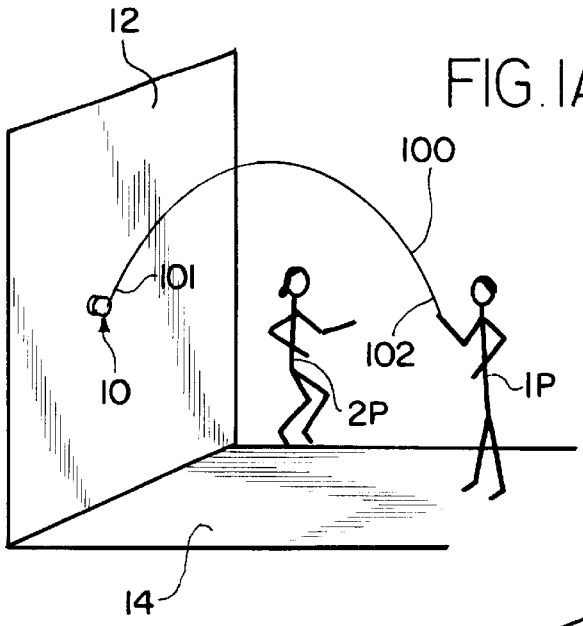
FIG. 1A
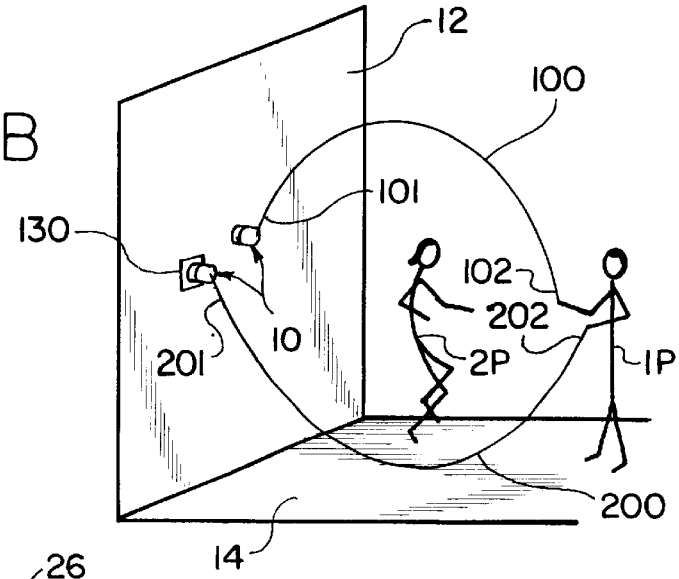
FIG. 1B
FIG. 4
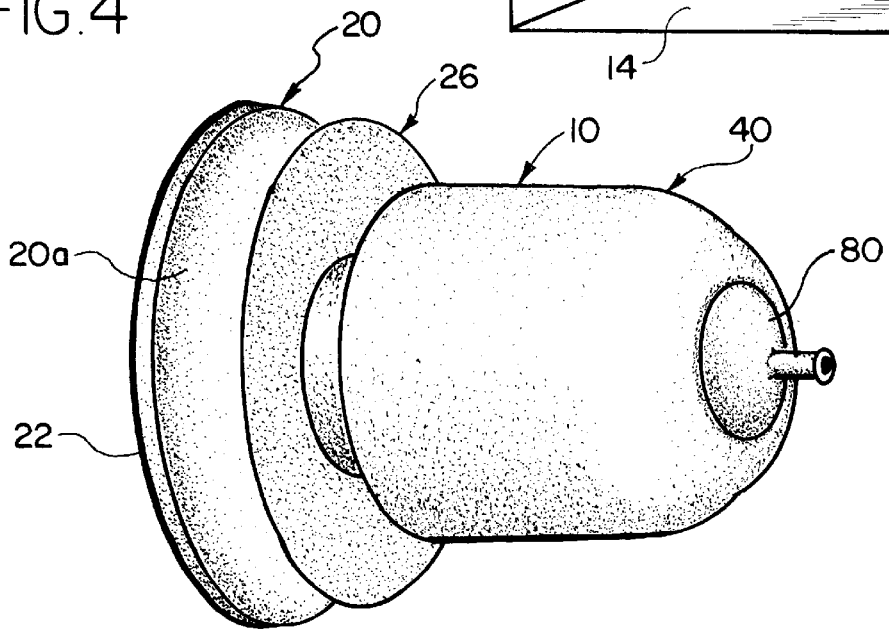

JUMP ROPE DEVICE

FIELD OF THE INVENTION

This invention generally relates to jump rope devices and more specifically concerns a new and improved rope end securing means to be known as a ■Jump Buddy■ (™) end securing means for easily and quickly attaching and detaching one end of the rope to a support surface such as a wall that can receive a suction holding device or an intermediary adhesive adapter therefor. In particular, the suction end securing device is a simple, durable, lightweight, safe and convenient arrangement comprised of a ball and socket allowing relatively friction free rotary movement of the rope end and a suction holding portion allowing quick attachment and detachment from a smooth surface. Where the supporting surface is not as smooth as required, an intermediary adhesive adapter may be quickly and easily attached to the supporting surface. The adapter may be left mounted for future use and easily detached when no longer needed.

BACKGROUND OF THE INVENTION

Jumping rope has long been recognized for the high level of aerobic exercise it provides to the entire body of the jumper. Authorities such as the American Heart Association and Canadian Heart Foundation encourage ■Jump Rope for Heart■ cardiovascular activities for adults. Schools have jump rope programs including teams and interscholastic competition to encourage as many children as possible to obtain the many benefits of jumping rope.

Rope Jumping may be done individually or in groups of three or more, however when two children play together one end of the rope must be tied to another structure of the correct height which, in the case of children, is usually a door handle or other handy protrusion. In such cases the rope twists upon usage and causes problems that tend to limit usage. This problem was addressed in U.S. Pat. Nos. 4,158,457 and 4,736,945 which disclose structures having a demountable receptacle secured to a support surface. In U.S. Pat. No. 4,158,457, one handle end of the rope is inserted directly into a plug that in turn is fastened to a support with screws or other means. In U.S. Pat. No. 4,736,945, the demountable receptacle is attached to a wall by a bayonet type mount which mount is permanently attached to a vertical surface by means of screws. While these patented structures help in those cases where the plug or receptacle happens to be in the right place and at the correct height for those who happen to want to jump at that time, the requirement for the relatively complicated, permanent or semipermanent attachment of a plug or receptacle with screws or similar means not only requires relatively high skill levels to install, but severely limits the locations of application and use. Thus, for example, large open areas around a home having a hard jumping surface are typically in a driveway and hence screwing a base into a typically thin metal or wood garage door panel or structure may not be practical or desirable. Moreover, when not in use, the rigidly mounted base could cause scratches or other injuries if people brush against them. With these prior art plugs or receptacles the place of application is also limited to those places where it may be permanently attached or where, if removed, would not leave the supporting surface such as a house side or door, badly marred with screw holes. For these prior art devices glass and other very hard surfaces such as masonry definitely are not available for mounting.

Another problem is that as children grow up, the recommended height at which the fixed end is to be placed must be moused upwards to accommodate their growth hence over time there will either be a group of bases or a single base with pairs of holes below.

Complicating this problem is that children, we have found, are spontaneous in their play with other children and prefer to carry the jump rope with then as they go off to find various friends to play with in various locations such as hones, school yards, parks and playgrounds. Requiring then to limit their rope jumping activities to places with a specific base already attached at the right height or to attach a base with a pair of accurately spaced screws before starting to play may impose legal, psychological and physical barriers that will Hague the effect of chilling and/or limiting their interest in jumping rope.

Another device for two jumpers is shown in U.S. Pat. No. 5,549,528 wherein a vertical pole includes a slidably mounted collar, said collar hauling eye-bolts receiving swiveling snap rings fastened to the adjacent ends of ropes. A handle on the other or turning end of the rope is used to prevent twisting of the rope when turned. In practice we have found that the swiveling snap fastener on this octopus arrangement will catch and turn unevenly and cause the rope to twist. Also the arrangement inhibits the turner from moving on the jump rope radius to accommodate any inadvertent change of position of the jumper, especially beginners who tend to jump forward out of the normal jumping area.

Accordingly, there is a need for a ■go anywhere■, lightweight. simple, durable very portable jump rope set that:

(a) may be simply and easily carried by even a small child from place to place easily and safely;

(b) may be quickly and easily attached to a variety of surfaces ranging from flat glass and painted wood to textured metal to bricks at the correct height required by the specific participants. Such attachment may be directly to the support surface or via an intermediary adapter;

(c) will not damage or leave marks on the attachment surface as a result of either attachment or detachment;

(d) may be quickly and easily detached by the user;

(e) is safe for the users and those around them;

(f) is durable and will withstand hard use for long periods of time;

(g) offers great adaptability and flexibility for users, parents and teachers to maximize and encourage the practice and teaching of rope jumping;

(h) provides very smooth and relatively frictionless turning so that the rope will turn evenly and not twist;

(i) allows the turner to easily accommodate changes of position of the jumper;

(j) eliminates the need for a second turner and maximizes the number of participants on every occasion; and (k) allows a variety of jump rope movements such as regular jumping, speed jumping and special tricks e.g. an individual jumping a rope within an outside rope being turned by another.

SUMMARY OF THE INVENTION

It is therefore an object of the ■Jump Buddy■ (™) invention to provide a readily portable jump rope and adapter that is easy to carry in a hand or bag by adults and school children. It is made of lightweight and durable materials and of an efficient carrying design that allows the rope to be conveniently wrappable about one or both ends to provide a small, compact package. A bag may be provided for convenience and to avoid accidental unwrapping.

Another object is to provide a means for easily, quickly and securely attaching one end of the jump rope to a wide variety of surfaces at the correct height required by the specific participants. In the preferred embodiment the means of attachment is a suction cup that readily and securely attaches to smooth support surfaces. Usually smooth surfaces such a metal, wood, or glass, etc. are expected to be found in the areas where rope jumping is likely to occur however in those instances where a smooth surface may not be available, we have provided an adhesive adapter means including a smooth outer surface with an adhesive backing of material such as 3M ■Command Strips■ ™. This adapter is adapted to be quickly and easily attached by simple pressure to a wide variety of surfaces including textured metal, cinder block, brick, etc. so that the jump rope is adaptable for use in just about any possible location where persons would be expected to want to jump rope. Depending on the adhesive used, some surfaces such as rough cinder block or brick may require surface preparation such as painting. The invention is user friendly, especially for children, because not only is it attachable by even small children without adult supervision, but because of its intuitive nature so that no or minimal instructions are necessary.

A further object of the invention is to provide for the quick and easy detachment of the end from the support surface. In the preferred embodiment the easy release is accomplished by means of a release ring structure adjacent the outer periphery of the suction cup which release ring is easily and intuitively grasped to effect release. Similarly the adhesive adapter has an arrangement that allows easy access to an adhering material which material may be easily grasped and intuitively removed without leaving any traces of its attachment.

Other objects are to provide a vacuum surface gripping means with the ability to maintain a secure hold for long periods of time and to not leave any permanent marks or evidence of its presence during or after attachment or detachment.

Yet another object is to provide a relatively inexpensive, yet durable construction including a relatively low friction smooth operating rotary ball and socket assembly that is smooth, allows easy adjustability of speed and avoids uneven or erratic turning and minimizes the possibility of rope twist and tangling. The ball and socket is more forgiving of mistakes in turning or jumping because of the wide range of points at which it allows the turner to be positioned on the arc having the point of attachment as its center. Thus, the ball and socket allows the turner to easily and confidently adjust their position to accommodate changes in the jumpers position. In one embodiment where it is desired to be able to readily change the rope being used, we have provided a socket cover in the form of a cylinder that is secure yet readily detachable for quick rope changes.

Safety of the users and those around then is another important object of the invention. Thus, the suction holding force of the rope support portion of the device effectively has specific parameters for maximum holding power and such parameters greatly increase the possibility that if a person such as a small child were to inadvertently run into the rope during use and get tangled up in it, the device would most likely release from its support. In such case the lateral shear force on the suction cup is designed to slide and/or cause leakage that effectively releases the end and allows it to move in the direction of the force. Moreover, if it does not automatically release, it may be quickly, manually and intuitively released by anyone present. Another safety feature is the softness of the gripping member which will prevent anyone coming in contact with the end from being injured. Similarly, the smooth adapter surface and rounded edges will not harm any who may brush against it. Also, the ball in the socket has some space to react and move if bumped. If it should somehow be jarred loose, the suction cup has been found to drop close to the support surface and not strike the jumper.

Furthermore, the minimum number of parts and their simplicity provides for easy and relatively inexpensive manufacture , assembly and maintenance.

BRIEF DESCRIPTION OF THE DRAWINGS

FIG. 1A is a schematic of two children using the device with one jump rope;

FIG. 1B is a schematic of two children using two devices with two jump ropes in a ■Double Dutch■ arrangement;

FIG. 4 is a perspective view of a stylized end device of FIG. 2;

DETAILED DESCRIPTION OF THE PREFERRED EMBODIMENTS

Figure 2:
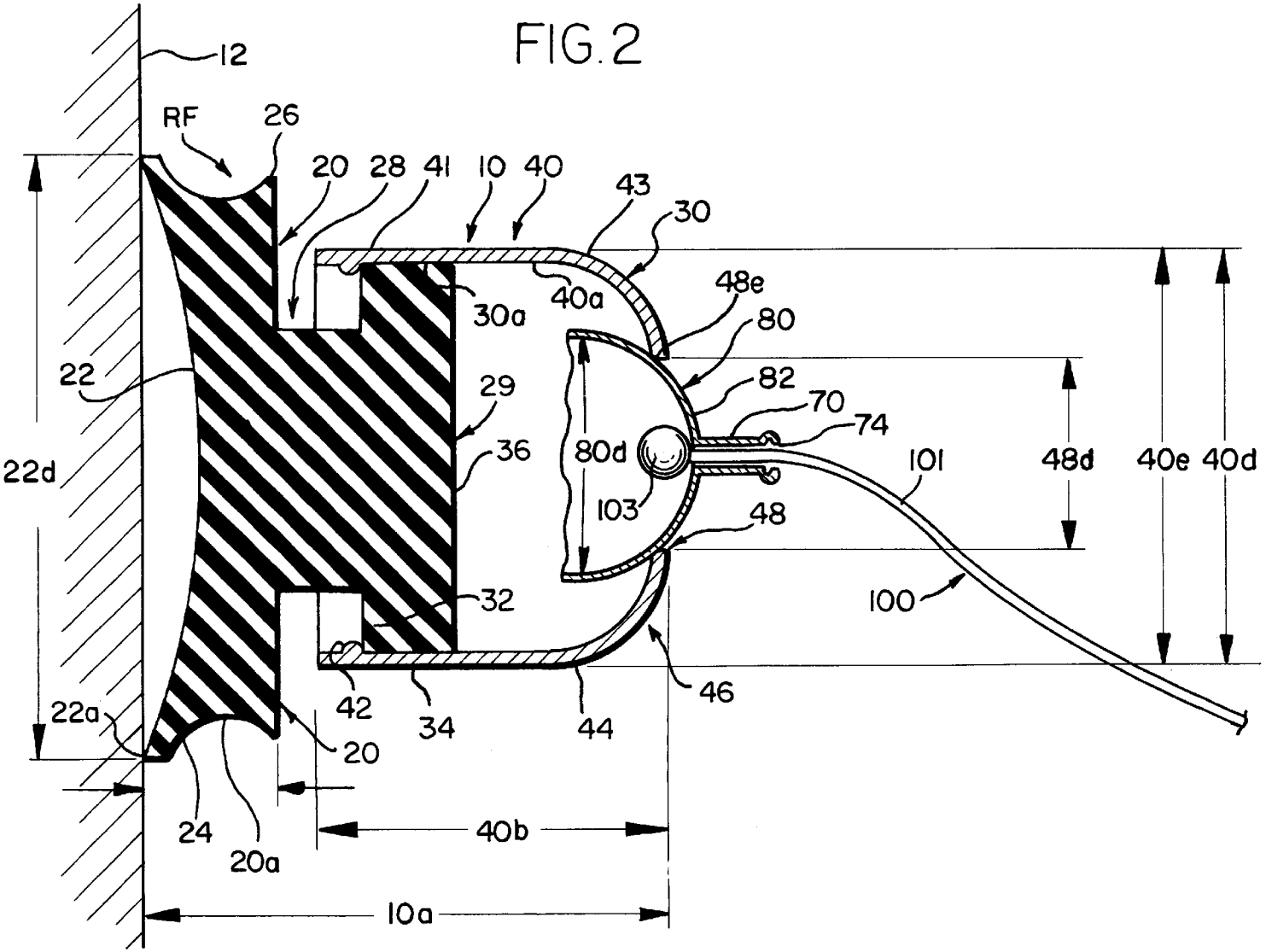
FIG. 2 is an enlarged cross section view of the rope end device attached directly to a support surface showing the suction gripping portion and the attached ball and socket rotating means having the enlarged rope end secured inside the ball portion.

With the many health, educational and coordination benefits associated with jumping rope it is important to provide a means for as many people as possible to be able to participate in this recreational sport. In accordance with the present invention two or more persons may safely and quickly enjoy the beneficial experience anywhere near a supporting surface that will accommodate the gripping device and/or an adapter therefor of the invention. conveniently, these supporting surfaces, usually vertical, but not necessarily, occur adjacent hard surfaces that are ideal for rope jumping including for example, walkways, garages, basements and school yards.

Referring to the drawings, FIG. 1A illustrates a ■Jump Buddy■ (™) rope end attachment device 10 according to the invention herein securing a first end 101 of jump rope 100 to a support surface 12. As shown, a first person 1P is turning rope 100 while a second person 2P is jumping up and down on a ground surface 14 adjacent the center of the rope where it contacts the ground. The support surface 12 may be a solid smooth generally vertical surface such as a garage door, house siding, etc. while the surface 14 may be a paved driveway, walk, or other suitable and convenient surface that lends itself to up and down jumping.

An advantage of the invention is that it is easy to use two ■Jump Buddy■ (™) rope end attachment devices 10 at the correct horizontal and vertical spacing as shown in FIG. 1B to enable two ropes 100 and 200 to be used as for example in a "Double Dutch" arrangement. This is significant because it is otherwise very difficult to find two places to secure the ends of two ropes in a desirable rope jumping area at the correct horizontal and vertical spacing for the jumpers involved.

Here the first ends 101 and 201 of ropes 100 and 205 respectively are secured to support surface 12 while the first person 1P holds the second ends 102 and 202 and, in the ■Double Dutch■ arrangement illustrated in FIG. 1B, rotates the ropes in a counter rotating manner requiring the second person 2P jump up and down twice as fast. For purposes of illustration, the ■Jump Buddy■ (™) attachment device 10 attached to first end 201 is shown mounted on an intermediary adapter 130 which is separately attached to support surface 12 as will be detailed hereinafter, while the ■Jump Buddy■ (™) attachment device 10 for rope end 101 is mounted directly on the support surface 12.

Figure 6:
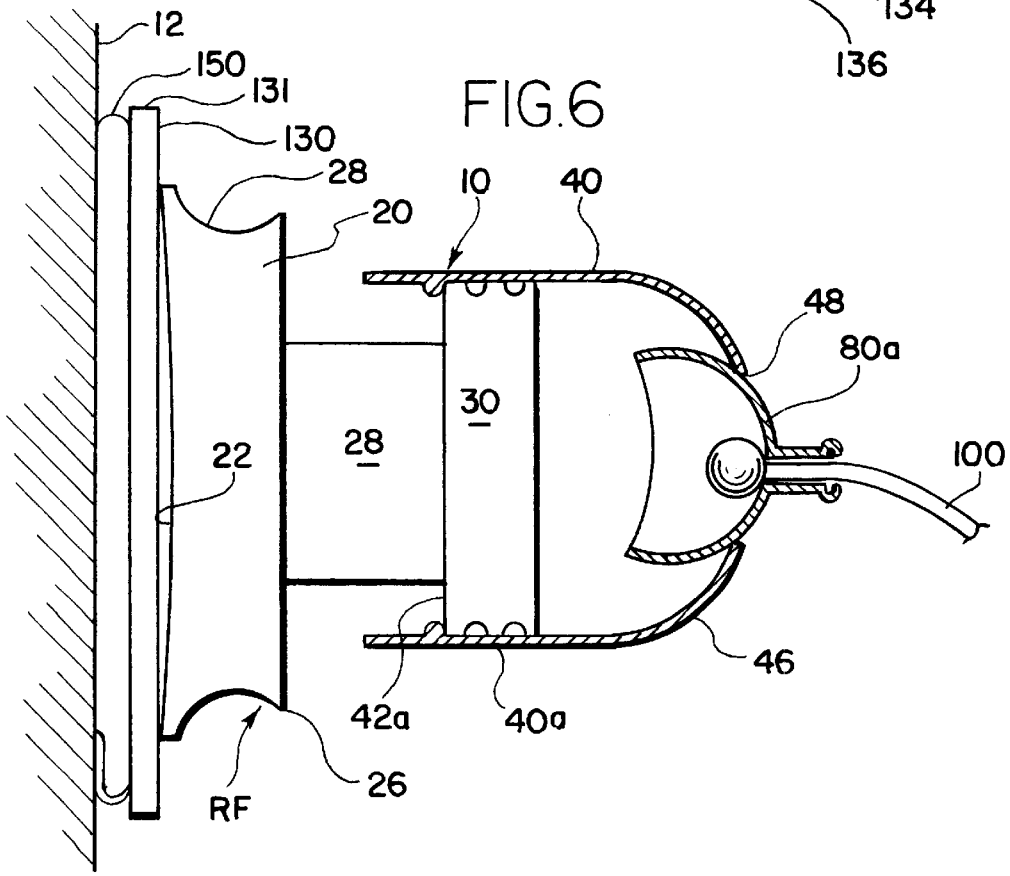
FIG. 6 is a cross sectional elevation view of the device attached to an adapter adhered to a support surface illustrating how the release force may be intuitively applied to detach the device and showing an embodiment wherein the socket cover may be detachably secured to the device with a snap type fit to allow quick changes of rope.

As shown in the elevation cross sectional view of FIG. 2, the preferred embodiment of the ■Jump Buddy■ (™) jump rope end attaching device generally indicated at 10 includes a suction or vacuum portion 20 and a rope pivot portion generally indicated at 30. The suction or vacuum portion 20 includes a suction or vacuum cup 22 of diameter 22*d* with a peripheral edge 22*a* that facilitates vacuum grip attachment to support surfaces 12 and/or intermediary 130, the latter as shown in FIG. 6.

Integral or connected with suction portion 20 is an intermediary portion 28 to which is secured the rope pivot connection portion 30. In practice both portions 28 and 30 may have cylindrical shapes. The rope pivot connection portion 30 includes a ball and socket arrangement of a socket structure 40 retaining a ball type structure 80 to provide a relatively friction free rope end connection portion.

The socket structure 40 includes a generally cylindrical structure of a outside diameter 40*d* and length 40*b* that is adapted to have a first end 41 portion with an inside diameter 40*e* grippingly encircling the intermediary or attachment portion 28 to provide a secure connection thereto. An integral second, opposite end 44 of a generally semi-spherical shape 46 provides an interior semi-spherical socket structure 43 that is adapted to hold ball 80 to which is connected a first end 101 of jump rope 100.

If it is desired to enhance the connection of the first end 41 with the attachment portion 30, inwardly projecting protrusion means or ridges such as shown at 42 may be provided on an interior surface 40*a* of structure 40 in a position where it or they bear against an undercut surface 32 of attachment portion 30. Other connection enhancing means (not shown) nay include screw threads or projections and depressions on mating surfaces 40*a* and 30*a*.

We have found that the suction portion 20 is best made of rubber or material having similar properties and that it is structurally advantageous, convenient and efficient to have the attachment portion 30 and portion 28 integral with portion 20. Preferably the rubber or elastomeric material is of a non-marking variety or type. Further, we have found that it is advantageous, convenient and efficient to make the structure 40,41,43 integral and of a hard, tough plastic material such as polycarbonate, PET or the equivalent. Similarly, ball 80 may be made of a hard, tough plastic such as high density polyethylene (HDPE). This combination has been found to provide a relatively friction free joint that provides the advantages of easy and consistent turning that avoids tangles.

The socket structure 43 includes a preferably circular opening 48 through which there projects an outwardly extending portion 82 of the captured ball 80 and an outwardly extending portion 70 through which a rope end is adapted to pass and be secured as for example by knot 103. The projecting portion 70 serves to minimize friction, minimize contact of the rope 100 with edge 48*e* and help align the ball in hole 48 after retraction. The ball in fact need only be half of a ball to allow ease of access to end 101, ease of manufacture and other efficiencies. The diameter 80*d* of ball 80 is smaller than the diameter 48*d* of opening 48 whereby the ball 80 cannot pass there through regardless of its angular position.

The projecting portion of the ball 70 has an opening 74 there through which opening receives a portion of the first end 101 of rope 100. The rope end 101 will have the suitable internal end securing member 103 such as a knot, clip or other connector means larger in diameter than the hole 74 on the inside of the ball 80 to hold the rope end in place. The internal smooth surface 40*a* on the inside of the socket structure 43 and the smooth and preferably rounded edge 48*e* of opening 48 helps facilitate very smooth and easy rotary movement that prevents twisting and tangling of rope 100. The smooth operation is an important aspect of the invention.

The suction portion 20 is also an important aspect of the invention in that it facilitates quick and easy attachment and detachment to and from supporting surfaces 12 either directly or through an adapter 130. We have discovered an efficient, lightweight, suction cup device in a form shown at 20 and 28 which is manufactured by All-Vac Industries of Skokie Ill. It provides about 35 psi suction in a convenient 3 ¼ inch diameter suction cup as shown at 22*d*. It is made of an elastomeric rubber material and has a projecting portion 28 that facilitates secure attachment of the socket portion 43 to the suction portion. The material is of a non-marking type whereby it will not leave evidence of its presence upon removal. The neck portion 28, here shown integral, connects the projecting portion 29 to the suction portion 20. Projecting portion 29 extends beyond neck 28 and includes an inner, radially outwardly projecting surface 32, a circumferential edge surface 34 and an outer surface 36.

Another important feature of the invention is that the suction portion 20 has a handy quick release mechanism. In our illustrated preferred embodiment it takes the form of a recessed circumferential groove 24 extending completely about the outer periphery 20*a*. This provides a circumferential lip 26 against which release pressure RP, such as may be applied by a finger or fingers, may be quickly, easily and intuitively brought to bear at any point around the circumference in a direction generally away from the support surface 12 to cause a portion of edge 22*a* to lift and break the vacuum in cup 22 and thereby release the grip of the device on the support surface 12 or adapter 130.

As shown in FIG. 2, one way of securely attaching the socket structure 40 to the projecting portion 29 is by means of protrusions 42 on an inner surface 40*a* of end 41 that may be effectively snap fitted over the outer end 29. Other connecting means besides those previously described may include a small ridge on the cylinder interior surface or by adding internal projections not shown. It has been found that by simply making the cylinder longer so that it extends beyond surface 32 will provide a sufficient grip between the rubber portion 29 and the inner surface 40*a* that will stay correctly positioned under appropriate use.

Figure 3:
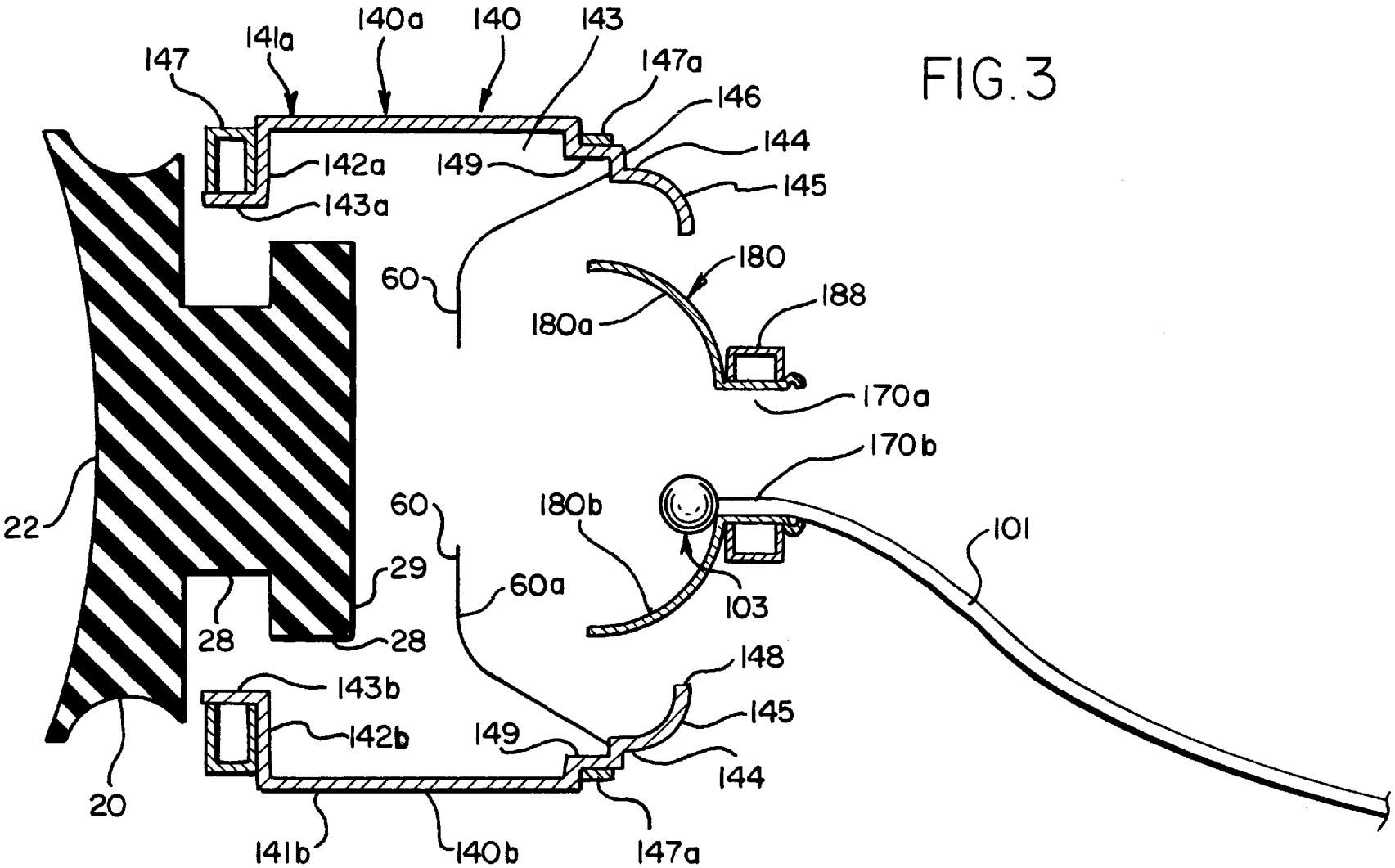
FIG. 3 is an exploded view of the structure generally similar to FIG. 2 but having a two piece construction with ridges and showing another means of assembly.

Although not required, there may be provided a socket defining inner socket member 60 such as shown schematically in FIG. 3 having a surface portion 60*a* adjacent to and spaced from the ball portion 80 to effectively limit its inward movement as may be desired.

With regard to relative sizes of the various components, it will be seen that half ball diameter 80*d* is greater than opening diameter 48*d* and this in turn is less than the outward diameter 40*d* of the socket structure 40. From our experience we have found that the diameter 22*d* of suction cup 22 should be greater than the socket structure diameter 40*d*.

Preferably the socket and ball structures 40 and 80 respectively may be made of molded high strength plastic material such as HDPE or polycarbonate by processes that will be well known to those skilled in the art.

FIG. 3 is an exploded view of another embodiment in which the suction and attachment portions 20, 28 and 29 are the same as for the first described embodiment but the otherwise similar socket and ball structures 140 and 180 are made of multiple pieces. Here the socket structure 140 is shown as including two portions, 140*a* and 140*b*, that are conveniently secured together by a suitable connecting means such as for example, an outer circumferentially extending band 147. To facilitate this construction, a first end 141*a* and 141*b* respectively of each of halves 140*a* and 140*b* may have a semi-circumferential lip means 142*a* and 142*b* respectively projecting therefrom in angular relationship thereto and each in turn has a further integral and axially projecting portions or ridges 143*a* and 143*b* respectively about which the band 147 may be applied and used to secure portions 140*a* and 140*b* against the neck 28. If and as required, a second outer band-like connector 147*a* may be positioned around an indentation structure 149 on the second end 146.

Similarly, ball 180 may be made of two portions 180*a* and 180*b* that are secured together at end portions 170*a* and 170*b* respectively by a connecting means such as a band device 188. This arrangement is particularly advantageous where it is desired that the ball and socket be easily and quickly disassembled to facilitate changes of rope.

An alternate socket structure 140 may include a stylized outer end such as for example with circumferential indentations 144 and 149 and a curved portion 145 surrounding opening 148. The indentations we have found add strength and enhance the appearance.

Although not required, there may be provided a socket defining inner socket member 60 such as shown schematically in FIG. 3 having a surface portion 60*a* adjacent to and spaced from the ball portion 180 to effectively limit its inward movement as may be desired.

FIG. 4 is a computer cad can rendition of a perspective view of the embodiment of FIG. 2. From it can be better understood the large, easy to grasp lip 26 surrounding the suction cup 22, which lip 26 provides a quick, easy and intuitive means to release the suction cup 22 from its supporting surface. It also shows the clean, eye appealing design having relatively long cylindrical smooth surfaces which look safe and non threatening to users, especially young children. Importantly, the smooth design minimizes the possibility of injury should a user inadvertently come in contact with it. It further provides a large cylindrical area around which the rest of the rope may be wrapped for convenient carrying in a neat, transportable package.

Although we have found that most desirable rope jumping areas are adjacent jump rope end support surfaces that are smooth and will allow ready attachment of a suction cup arrangement of the invention herein, it is recognized that accommodation must be made for those instances in which no suitable support surfaces exist, as for example, when the surfaces are of a material such as cinder block, brick or textured metal For those instances we have developed a quick and easy adapter generally indicated at 130 as shown in FIGS. 5A–D which comprises a relatively rigid planar flat plate structure 131 having an inner, support surface facing surface 132 and an outer suction cup engaging surface 133 of a suitably large, flat and smooth area that will easily accommodate the suction cup diameter 22*d*. The inner surface 132 is of a size which will provide an area of sufficient size and texture to accept material such as adhesive that will allow attachment and detachment of the adapter 130 to and from the otherwise non-suitable surfaces.

As shown in FIGS. 5A–D, we have found a solution to the situations in which there is no suitable support surface that will receive and retain the suction cup 22 under normal operating conditions. Thus, we have discovered that applying a suitable non-marking adhesive on the back of the plate 131 will allow quick and easy attachment. As shown, this may comprise applying a number of similar adhesive strips 150 such as made by 3M Company and sold as Command (™) Adhesive Strips to the inside surface 132 of adapter plate 131 will provide a convenient, user friendly means of applying the adapter 130 to the support surface 12 so that it will function under a very wide set of conditions. Moreover the strips 150 are readily removable without leaving any evidence of their attachment.

While we have shown six narrow strips 150, it will be understood that varying conditions such-as strip size, adapter size and shape, surface texture, type of adhesive, expected operating forces, etc. may dictate more or less strips 150 are necessary to achieve the desired adherence. Thus, for example, instead of six narrow strips one or two wider strips of essentially the same holding power may be used.

Figure 5A:
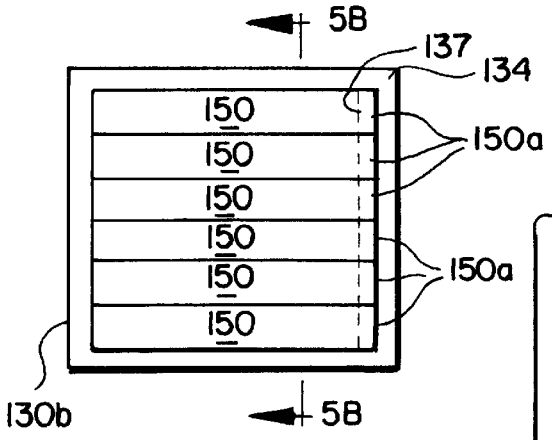
FIGS. 5A, 5B, 5C and 5D are back, cross sectional side, front and top views respectively of an intermediary adapter arrangement for providing a smooth surface on support surfaces that would otherwise be too rough to properly hold the suction assembly.
Figure 5B:
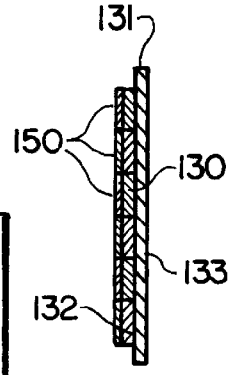
Figure 5C:
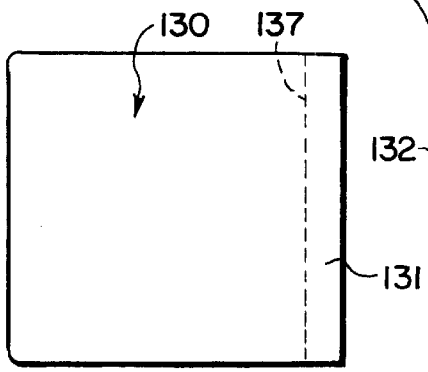
Figure 5D:
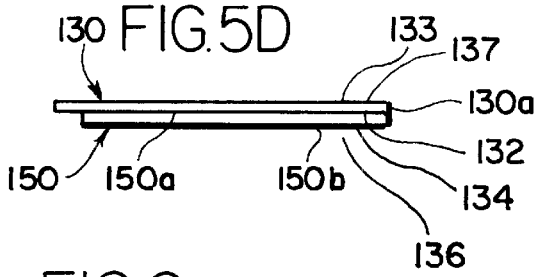

The strips 150 are applied with surface 150 pressed against the inner surface 132 in various patterns as for example, the parallel arrangement shown in FIG. 5A. The adapter plates 130 may be provided with the adhesive in place so that all that will be required of the user is to remove a backing sheet and to press the plate 130 against the support surface at the desired location.

In practice, on a painted textured metal garage door, we have found that three strips 150 are adequate. Of course adhesives or tapes other than those manufactured or sold by 3M nay be used, however from our experience we strongly recommend the use of non-marking adhesive to avoid leaving unsightly reminders. This is especially true for children who may take their device to the homes of friends and relatives.

Removal of the adapter 130 is facilitated by lifting a non-adhering flap 134 which folds the adapter plate 131 along a flexible seam 137 outward form the support surface 12. The ends 150*a* of strips 150 will then be exposed and can be grasped and pulled parallel to the support surface 12 causing the adapter to disconnect from support surface 12. Once plate 131 is removed, the plate may be reused in a different location with the same or different strips 150. No marks are evident on the support surface or the surface 132.

In use, the adapter is attached to a support surface 12 at an appropriate height and location by pressing the plate 131 with strips 150 attached against the support surface 12.

The ■Jump Buddy■ (™) attachment device 10 is mounted on an appropriate support surface 12 or adapter 130 by simply forcing or pressing vacuum cup 22 against the surface 12 or 133 respectively to drive out as much of the air in the cup as possible whereby a vacuum is created and held in by circumferential edge 22*a*; now having a greater contact area as a result of the flattening of the cup 22. Applying moisture to the edge 22*a* has been found to enhance the vacuum.

Detachment of device 10 is effected by simply applying a release force RF against lip 26 as shown in FIGS. 2 and 6 whereby the edge 22*a* will be raised and the vacuum released. This quick and easy release and its intuitive nature provide ease of use and an important safety feature. Thus, for example, should a jumper lose his or her balance and fall and become tangled with the rope around their neck, it would be intuitive and simple for either of the participants to grab the lip 26 and release the device 10.

Actually, this release may not be necessary in most instances since a force with a large component parallel to the support surface 12 will cause lateral slippage of the vacuum cup due to the relatively small surface contact area. This slippage will likely cause leakage and a loss of vacuum in the cup 22 whereby it will release itself.

The adapter 130 is particularly useful in situations such as gymnasiums with painted cinder block walls or on a steel garage door with a wood textured finish. The adapter can be mounted and used numerous times without the necessity of removal. It can be made in various configurations, sizes and colors to match the surface on which it is being mounted and add an attractive decoration. The flat outer surface 133 is smooth with round edges providing a safe surface when not in use. The adapter will not interfere with normal operation of the garage door when it has been appropriately mounted and the rope and securing device 10 is detached. We have found that teachers can set up numerous learning stations in a gymnasium, attach and detach ropes from the adapters as needed, and leave adapters on the support surfaces 12 when not in use.

From the foregoing it may be seen that we have provided a valuable improvement of an old favorite toy and one of the best aerobic and educational devices ever invented. The improvements should enhance the attractiveness of jump ropes and make then ever more popular and effective in promoting such important lifelong attributes as muscle and eye coordination, balance and aerobic well being while at the same time making it fun. By eliminating the need for one turner we have increased the opportunity for more jumpers to participate.

Our experience using jump ropes in teaching physical education is that the ■Jump Buddy■ (™) invention is very user friendly, especially for children; easy and fun to use; quick to set up and take down for children and adults alike; smooth operating; safe and durable. The ball and socket arrangement makes it easy for young children to power the rope themselves without twisting or entanglement of the rope that we have found occurs in other devices.

When turned at various speeds. heights and patterns, the ball and socket joint is accommodating to the beginner. The small projection 70 from the ball protects the rope from constant friction against the socket and the opening 48.

The rounded edges of the cylinder provide a safe end surface while the relative heavier weight of the end attachment device 10 compared to the lighter weight of the rope causes the attachment end to fall close to the support surface and not near the users if device 10 should happen to become disconnected during play.

In addition, this device allows participants to easily jump rope in many different locations. Thus, the device 10 can be easily carried from place to place by even a young child and can be easily and quickly attached to most support surfaces adjacent to driveways, floors, playgrounds or other appropriate rope jumping areas.

Where a smooth supporting surface is not available, an easy to use and simple adapter 130 has been provided.

An intended purpose of this ■Jump Buddy■ (™) invention 10 is to provide a ■go anywhere■, lightweight, simple, portable and durable jump rope set that will encourage and facilitate people to learn and develop the skills of turning a jump rope and jumping rope to provide all of the benefits attendant thereto. The invention also is intended to increase the locations where ropes may be jumped and restore the fun.

Use of the ■Jump Buddy■ (™) invention allows for jump rope turning skills to be learned in isolation before coordinating them with another person. The beginner can also practice jumping rope turned by an experienced person such as a parent, sibling or teacher. As the users jumping and turning skills develop, new skills, including the use of two ropes can also be practiced. Working in pairs as partners rather than in groups of three (as would be necessary without the invention) allows participants greater opportunity for success, more ■time on task■ in a teaching situation, improved fitness and less time waiting for a turn. By applying the securing means 10 to a surface, a beginner can first learn to appropriately turn the rope without the necessity of coordinating their movements with those of another participant and thereby avoid the problems and distractions which may arise when two children attempt to do something.

The method for quickly attaching a first end 101 of a jump rope to and from a support surface 12 includes the first step of providing a jump rope with a first end connected to a support surface attachment device 10. The support surface attachment device 10 has a suction portion 20 providing vacuum attachment to a supporting surface and a rope connection portion 30 having a relatively friction free pivotable connection to the first end of the rope. A second step includes attaching the attachment device 10 to the selected support surface 12 by pressing the suction portion 20 until adequate holding force has been obtained. The suction portion has a periphery and there is a lip structure 26 along the periphery. The method includes the third step of detaching the suction portion from the support surface by a person engaging the lip structure 26 with his or her finger or fingers and applying a force RF in a direction generally away from the support surface. The method may include the further step of applying an adapter plate between said support surface and said suction portion when a suitable support surface cannot be found during the step of selecting the suitable place to attach said attachment device.

From the foregoing it may be understood that according to our invention we have provided a jump rope arrangement that meets all of the needs enumerated in (a) though (k) in the background of the invention.

With respect to the above description of the invention it is to be recognized that the optimum dimensional relationships for the parts of the invention including variations in size, materials, shape, form, function and manner of operation, assembly and use are within the purview of those skilled in the art and all equivalent relationships to those illustrated in the drawings and described in the specification are intended go be encompassed by the present invention.

Therefore, the foregoing is considered as illustrative only of the principles of the invention which the inventors have shown in the preferred embodiments and since with that in mind numerous modifications and changes will readily occur to those skilled in the art, it is not desired to limit the invention to the exact construction and operation shown and described, but to include all suitable modifications and equivalents falling within the scope of the invention as set forth in the following claims in which

We claim:

1. A device by which an end of a jump rope may be readily attached to and detached from a generally planar support surface, said device comprising a vacuum portion and a rope pivot portion, said vacuum portion including a flexible vacuum cup structure having a surface engaging rim lying in a plane, said plane adapted to be generally parallel to or integral with said support surface when attached, said vacuum portion adapted to be easily and quickly adhered to said support surface by pressing the vacuum cup, said vacuum cup structure adapted to be easily and quickly removed from said supporting surface by means of a quick release mechanism for quickly and easily breaking a vacuum in said vacuum cup thereby facilitating responses for emergency release, said quick release mechanism including a generally outwardly projecting lip-like portion located in areas generally about the periphery of said vacuum cup, said lip-like portion being spaced away from the plane of the rim of said vacuum cup and forming a recessed area therebetween in those portions where said lip-like portion is located whereby release pressure may be easily applied in said recessed areas to quickly and easily effect a release of the pressure in said vacuum cup, said rope pivot portion including a rope securing portion and a rotatable joint structure, said joint structure allowing relatively friction free rotation of said securing portion.

2. A device according to claim 1 wherein said vacuum cup structure is made of an elastomeric rubber material of a type that will firmly adhere to a support surface but will not leave evidence of its presence upon removal from said supporting surface.

3. A device according to claim 1 wherein said rope pivot portion includes a ball and socket structure rotatable about an axis generally perpendicular to said plane of said rim and wherein said ball structure is captured within said socket and is adapted to be attached to a rope end, said socket structure being secured to said vacuum portion.

4. A device according to claim 3 wherein said vacuum portion has a projecting portion and said socket structure is secured to said projecting portion.

5. A device according to claim 4 wherein said socket structure has a circular opening therein and said ball structure has an outwardly extending generally cylindrical portion through which a rope end is adapted to pass, said opening having a smooth, generally friction free surface and said outwardly extending portion passing through said opening thereby minimizing fiction between said ball and socket and protecting said rope from contact with said opening.

6. A device according to claim 5 wherein said ball has an outer generally friction free smooth surface and said socket has an inner generally friction free smooth surface whereby said ball rotates smoothly and freely in said socket.

7. A device according to claim 4 wherein said socket structure is made of multiple pieces, said multiple pieces being secured to said projecting portion with an outer band, said projecting portion having an outer surface and said multiple pieces having an inner surface, said multiple pieces having circumferential ridges on said inner surfaces, said ridges providing a gripping force against said projecting portion.

8. A device according to claim 1 including an adapter plate having an inner surface and an outer surface, said outer surface being flat and smooth to provide a firm base for said vacuum portion to enable said vacuum portion to resist a first generally perpendicular force, said inner surface having an adhesive material firmly adhered thereto, said adhesive material being capable of being securely attached to a wide variety of support surfaces to resist a second generally perpendicular force wherein said second force is greater than said first force.

9. A device according to claim 8 wherein said adhesive material comprises a plurality of similar strips which may be varied in number to vary the total adhesive force holding said adapter plate on said support surface.

10. A device according to claim 9 wherein said adhesive strips have an inner surface and an outer surface, a portion of said inner surface having a strip of nonadhering material thereon whereby removal of the adapter is facilitated by removal of said strip of nonadhering material.

11. A jump rope assembly comprising a jump rope and an end attachment device; said jump rope having first and second ends; said end attachment device comprising a suction portion and a rope connection portion; said vacuum portion including a flexible vacuum cup structure having a surface engaging rim lying in a plane, said plane adapted to be generally parallel to or integral with said support surface when attached, said vacuum portion adapted to be easily and quickly adhered to said support surface by pressing the vacuum cup, said vacuum cup structure adapted to be easily and quickly removed from said supporting surface by means of a quick release mechanism for quickly and easily breaking a vacuum in said vacuum cup to facilitate responses to emergencies, said quick release mechanism including a generally radially outwardly projecting lip portion located in areas generally about the periphery of said vacuum cup, said lip portion being spaced from the rim of said vacuum cup and forming a grove-like structure therebetween in those portions where said lip is located whereby release pressure may be easily applied by a persons fingers in said grove-like structure against said projecting lip to easily and quickly effect a release of the pressure in said vacuum cup, said rope pivot portion including a rope securing portion and a rotatable joint structure, said joint structure allowing relatively friction free rotation of said rope securing portion.

12. A method for quickly attaching and detaching a first end of a jump rope to a support surface includes the steps of providing a jump rope with a first end connected to a support surface attachment device, said support surface attachment device having a vacuum cup suction portion providing vacuum attachment to a supporting surface and a rope connection portion having a relatively friction free pivotable connection to said first end of said rope, selecting a support surface suitable to attach and hold a vacuum cup and of the correct height and adjacent a ground surface suitable for jumping rope, attaching said attachment device to said selected support surface by pressing the suction portion until air has been squeezed out of said cup and an adequate holding force has been obtained with said support surface, said suction portion further including a quick release structure in the form of a grove-like structure around the periphery of said vacuum cup suction portion and said method includes the step of applying a force to said quick release structure to break the vacuum in said vacuum cup.

13. A method according to claim 12 including the further step of applying an adapter plate between said support surface and said suction portion when a support surface suitable to receive and hold a vacuum cup cannot be found during the step of selecting the suitable place to attach said attachment device.

* * * * *